United States Patent [19]

Chen

[11] Patent Number: 4,513,222

[45] Date of Patent: Apr. 23, 1985

[54] COLOR PICTURE TUBE HAVING RECONVERGENCE SLOTS FORMED IN A SCREEN GRID ELECTRODE OF AN INLINE ELECTRON GUN

[75] Inventor: Hsing-Yao Chen, Landisville, Pa.

[73] Assignee: RCA Corporation, Princeton, N.J.

[21] Appl. No.: 461,584

[22] Filed: Jan. 27, 1983

[51] Int. Cl.[3] ..... H01J 29/51; H01J 29/62

[52] U.S. Cl. ..... 313/412; 313/414

[58] Field of Search ..... 313/412, 414

[56] References Cited

U.S. PATENT DOCUMENTS 3,772,554 11/1973 Hughes ..... 313/412
3,873,879 3/1975 Hughes ..... 315/13 C
4,234,814 11/1980 Chen et al. ..... 313/412
4,318,027 3/1982 Hughes et al. ..... 315/15
4,449,069 5/1984 Assil et al. ..... 313/412

FOREIGN PATENT DOCUMENTS 70662 6/1978 Japan ..... 313/414

*Primary Examiner*—Palmer Demeo
*Attorney, Agent, or Firm*—Eugene M. Whitacre; Dennis H. Irlbeck; Vincent J. Coughlin, Jr.

[57] ABSTRACT

An inline electron gun in a color picture tube is improved by the addition of two slots that are spaced sufficiently close to and inward from the two apertures in a portion of the screen grid electrode facing an accelerating and focusing electrode. The slots cause a distortion of the electrostatic field formed between the two electrodes at the two apertures. The field distortion compensates for an opposite distortion within the main lens of the electron gun.

16 Claims, 8 Drawing Figures

COLOR PICTURE TUBE HAVING RECONVERGENCE SLOTS FORMED IN A SCREEN GRID ELECTRODE OF AN INLINE ELECTRON GUN

This invention relates to color picture tubes having improved inline electron guns, and particularly to an improvement in such guns for reducing the horizontal motion of the outer electron beams caused by changes in the focus voltage applied to the guns.

BACKGROUND OF THE INVENTION

An inline electron gun is one designed to generate or initiate preferably three electron beams in a common plane and direct those beams along convergent paths in that plane to a point or small area of convergence near the tube screen. In one type of inline electron gun, such as that shown in U.S. Pat. No. 3,772,554, issued to R. H. Hughes on Nov. 13, 1973, the main electrostatic focusing lenses for focusing the electron beams are formed between two electrodes referred to as the first and second accelerating and focusing electrodes. These electrodes include two cup-shaped members having the bottoms of the members facing each other. Three apertures are included in each cup bottom to permit passage of three electron beams and to form three separate main focus lenses, one for each electron beam. In such electron guns, static convergence of the outer beams with respect to the center beam is usually attained by offsetting the outer apertures in the second focusing electrode with respect to the outer apertures in the first focusing electrode.

It has been noted that the horizontal beam landing locations of the outer electron beams, in color picture tubes having the above-described electron gun, change with changes in the focus voltage applied to the electron gun. It therefore is desirable to improve such inline electron guns to eliminate or at least reduce this sensitivity to focus voltage changes.

U.S. Pat. No. 4,449,069 issued to N. Z. Assil et al., on May 15, 1984 and assigned to the same assignee as the present invention, proposes a structure for reducing the horizontal motion of the outer electron beams caused by changes in the focus voltage. In the Assil et al. electron gun structure, designed to operate at an ultor voltage of 25 kV and a focus voltage of 7 kV, two slot apertures are formed in a portion of a focusing electrode facing a screen grid electrode. The slot apertures are closedly spaced to and outward from the two outer beam apertures of the focusing electrode. The slot apertures cause a distortion of the electrostatic field formed between the focusing electrode and the screen grid electrode at the outer beam apertures to converge the two outer beams toward the center beam. The spacing between the additional slot apertures and the outer beam apertures in the Assil et al. structure, i.e. the web spacing, is in the range of 0.60 mm to 1.50 mm. Since the thickness of the focusing electrode is only 0.25 mm, the metal web separating the beam apertures from the slot apertures does not possess a great deal of structural strength and may become distorted during the beading operation when alignment pins are positioned within the beam apertures. Since the electron beams have a high velocity in the vicinity of the focusing electrode, it is not feasible to move the slot apertures in the focusing electrode further outward from the outer beam apertures to strengthen the web, because the effect of the slot apertures on the electrostatic field would be decreased to the point where little reconvergence of the outer beams toward the center beam would occur. In some applications, it is desirable to operate the electron gun at 30 kV ultor potential with a focus voltage of 8.5 kV. In such an electron gun, the electron beams in the vicinity of the focus electrode would experience an even higher velocity than described above for an electron gun operation at an ultor potential of 25 kV and a focus voltage of 7 kV. It is known that the electron velocity is proportional to the square root of the voltage; therefore, to reconverge the outer beams using the teaching of the Assil et al. patent would require locating the slot apertures closer than the above-described range of 0.60 mm to 1.50 mm. Such a positioning would reduce the web spacing between the outer beam apertures and the slot apertures to the point where distortion of the outer beam apertures of the focusing electrode would almost certainly occur.

SUMMARY OF THE INVENTION

An inline electron gun in a color picture tube is improved by the addition of two reconvergence slots that are spaced sufficiently close to and inward from the two apertures in a portion of a screen grid electrode facing an accelerating and focusing electrode to cause a distortion of the electrostatic field formed between the focusing electrode and the screen grid electrode at the two apertures.

DETAILED DESCRIPTION OF THE PREFERRED EMBODIMENT

Figure 1:
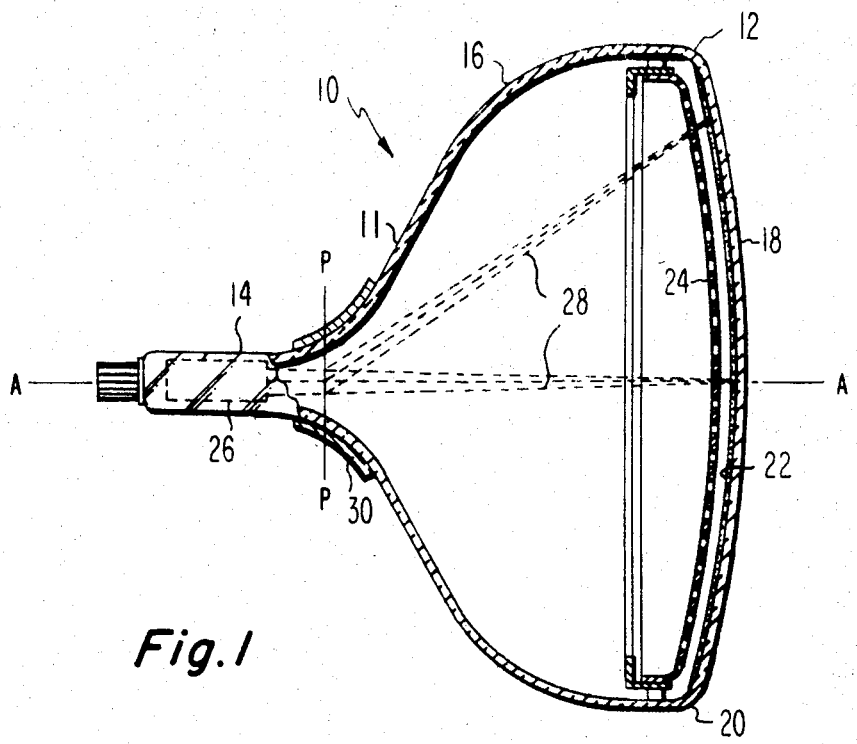
FIG. 1 is a plan view, partly in axial section, of a shadow mask color picture tube embodying the invention.

FIG. 1 is a plan view of a rectangular color picture tube 10 having a glass envelope 11 comprising a rectangular faceplate panel or cap 12 and a tubular neck 14 connected by a rectangular funnel 16. The panel comprises a viewing faceplate 18 and peripheral flange or sidewall 20 which is sealed to the funnel 16. A mosaic three-color phosphor screen 22 is carried by the inner surface of the faceplate 18. The screen 22 is preferably a line screen with the phosphor lines extending substantially perpendicular to the high frequency raster line scan of the tube (normal to the plane of FIG. 1). Alternately, the screen could be a dot screen as is known in the art. A multiapertured color selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along spaced coplanar convergent paths through the mask 24 to the screen 22.

The tube of FIG. 1 is designed to be used with an external magnetic deflection yoke, such as the yoke 30 schematically shown surrounding the neck 14 and funnel 16 in the neighborhood of their junction. A YAM (Yoke Adjusting Machine, not shown) is utilized to precisely adjust the yoke 30 on the tube 10. The tube is operated during the YAM operation with an optimum focus voltage in order to obtain the desired adjustment. Adjusting the yoke 30 horizontally with respect to the electron beams increases the width and height of the raster generated by one of the outer beams while reducing the width and height of the other outer beam raster. A vertical yoke motion causes a raster rotation of the outer beams; one beam rotates clockwise and the other counterclockwise. After adjustment, the yoke is held in position on the tube using, for example, a hot-melt adhesive. When activated, the yoke 30 subjects the three beams 28 to vertical and horizontal magnetic flux which cause the beams to scan horizontally and vertically, respectively, in a rectangular raster over the screen 22. The initial plane of deflection (at zero deflection) is shown by the line P—P in FIG. 1 at about the middle of the yoke 30. For simplicity, the actual curvature of the deflected beam paths in the deflection zone is not shown in FIG. 1. A readjustment or change in focus voltage from the optimum focus voltage used during the above-described YAM operation changes the focus voltage—vultor voltage ratio of the electron gun and results in a change in the relative strength or focal length of the main electrostatic focus lens with a resulting misconvergence of the outer beams relative to the center beam.

Figure 2:
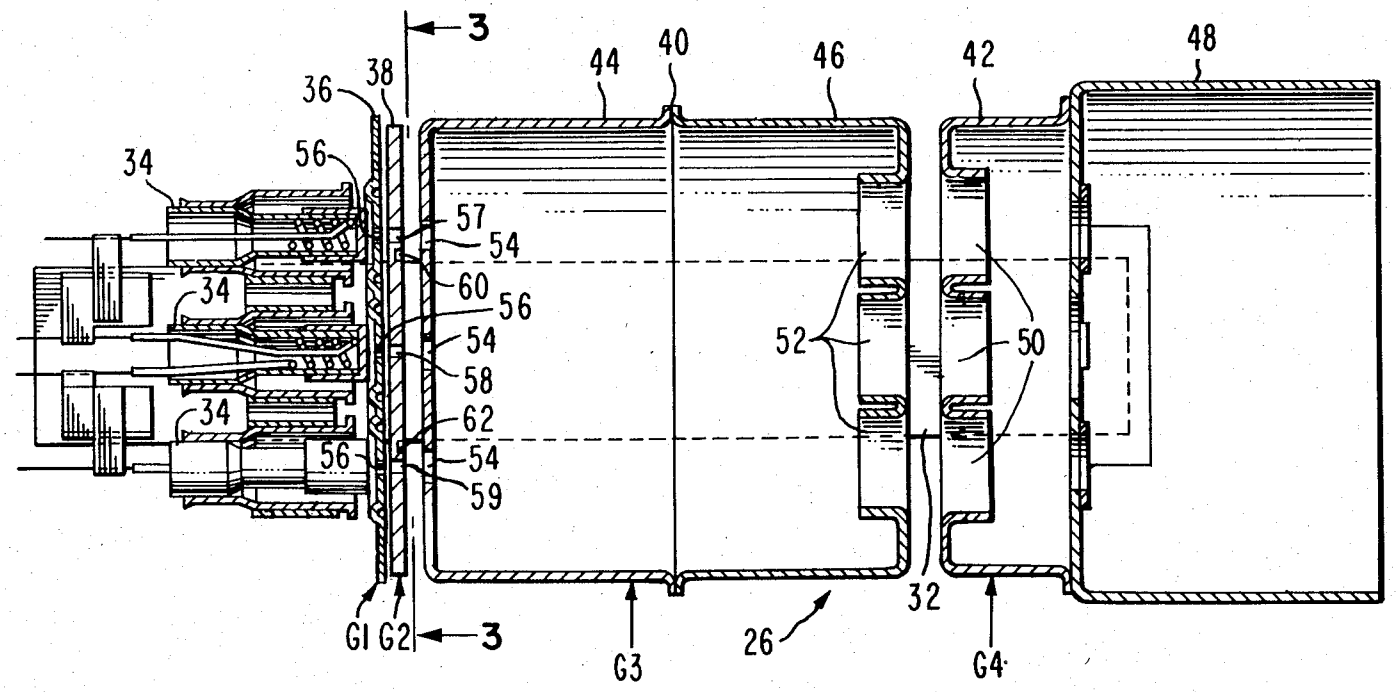
FIG. 2 is a partial axial section view of the electron gun shown in dashed lines in FIG. 1.

The details of the improved electron gun 26 are shown in FIG. 2. The gun comprises two glass support rods 32 (one shown) on which various electrodes are mounted. These electrodes include three equally spaced coplanar cathode assemblies 34 (one for each beam), a control grid electrode 36 (G1), a screen grid electrode 38 (G2), a first accelerating and focusing electrode 40 (G3), and a second accelerating and focusing electrode 42 (G4), spaced along the glass rods 32 in the order named. All of the post-cathode electrodes have at least three inline apertures in them to permit passage of three coplanar electron beams. The main electrostatic focusing lens in the gun 26 is formed between the G3 electrode 40 and the G4 electrode 42. The G3 electrode 40 is formed with two cup-shaped elements 44 and 46, the open ends of which are attached to each other. The G4 electrode 42 also is cup-shaped, but has its open end closed with a shield cup 48. The portion of the G4 electrode 42 facing the G3 electrode 40 includes three inline apertures 50, the outer two of which are slightly offset outwardly from corresponding apertures 52 in the G3 electrode 40. The purpose of this offset is to cause the outer electron beams to converge with the center electron beam. However, misconvergence can occur if the focus voltage on the G3 electrode 40 is changed significantly from the optimum focus voltage utilized during the YAM operation described above. The side of the G3 electrode 40 facing the G2 electrode 38 includes three apertures 54 which are aligned with apertures 56 in the G1 electrode 36 and with apertures 57, 58 and 59 in the G2 electrode 38.

Figure 3:
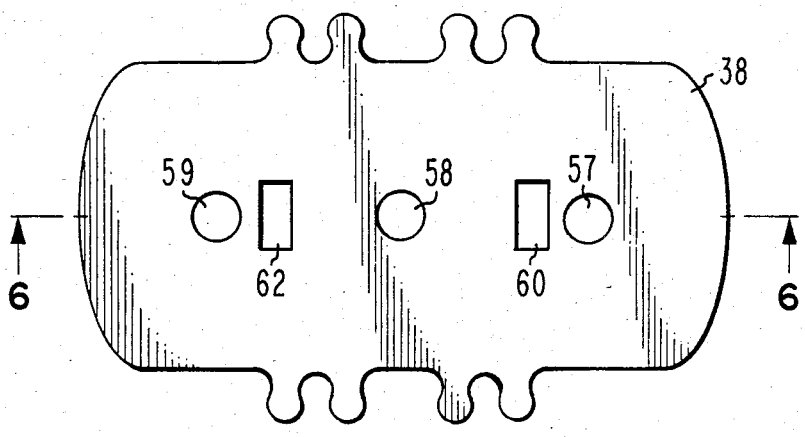
FIG. 3 is an enlarged elevational view of a G2 electrode taken at line 3—3 of FIG. 2.
Figure 6:
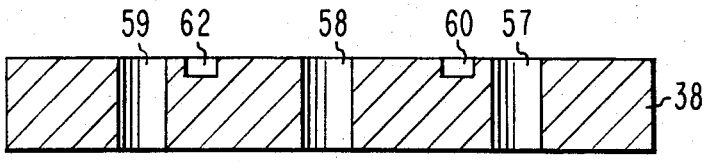
FIG. 6 is an enlarged cross-sectional view of the G2 electrode taken along line 6—6 of FIG. 3.

The electron gun 26 is improved by the addition of two rectangularly-shaped reconvergence slots 60 and 62 spaced inwardly from the outer apertures 57 and 59, in the G2 electrode 38, as shown in FIGS. 2, 3 and 6. Although the slots 60 and 62 are shown as rectangular in shape, it should be understood that the present invention also includes other shaped slots, e.g., arcuate shaped. The purpose and function of the slots 60 and 62 can be discussed with reference to FIGS. 4 and 5.

Figure 4:
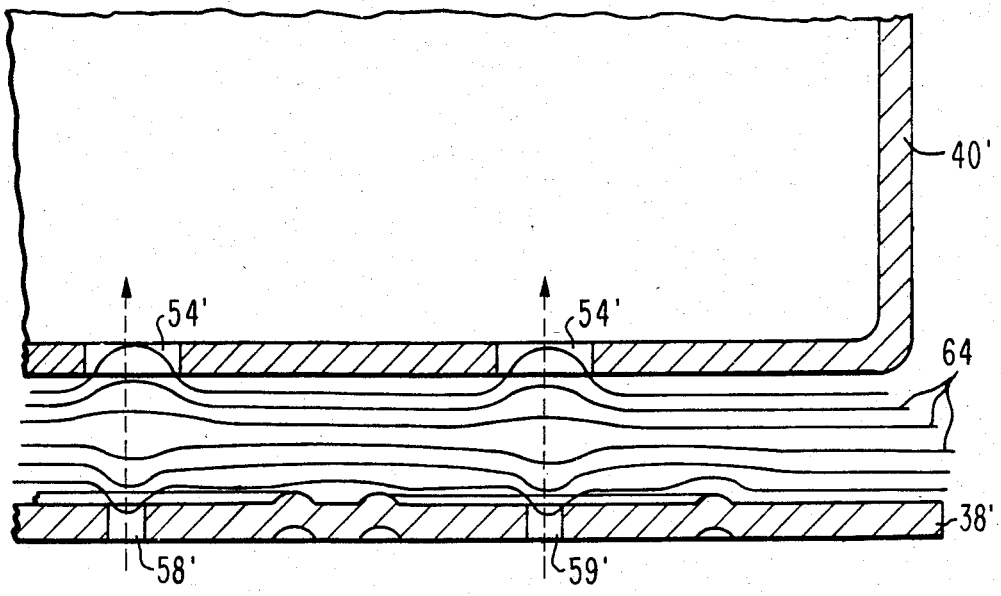
Fig. 4 PRIOR ART
FIG. 4 is an enlarged sectional plan view of portions of the G2 and G3 electrodes in a prior art electron gun, also showing the associated electrostatic equipotential field lines.

FIG. 4 shows the electrostatic equipotential field lines 64 between a G2 screen grid electrode 38′ and a G3 focus electrode 40′ of a prior art electron gun. (Parts similar to those of the present novel electron gun 26 are designated with a prime of the corresponding numeral.) The field lines 64 at both the outer aperture 59′ and the center aperture 58′ of the G2 electrode 38′ are substantially symmetrical with respect to the center lines of the apertures. Electron beams passing through the centers of the apertures would experience symmetrical forces and would continue along their straight paths.

Figure 5:
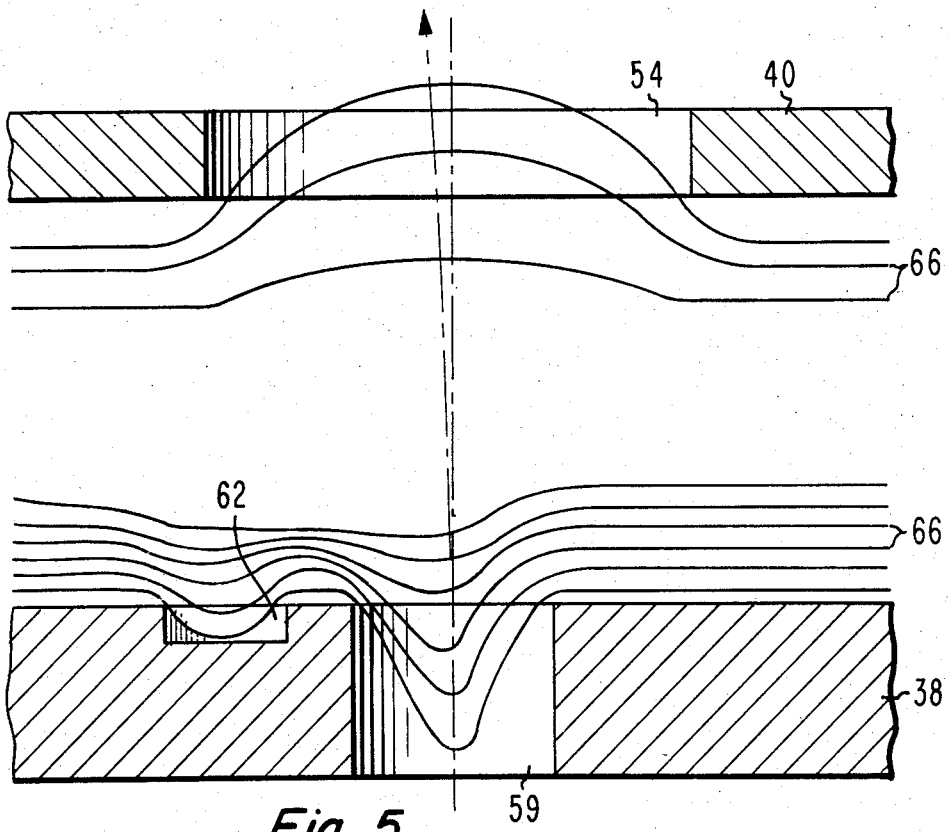
FIG. 5 is an enlarged sectional plan view of portions of the G2 and G3 electrodes of the electron gun of FIG. 2, also showing the associated electrostatic equipotential field lines.

FIG. 5 shows a portion of the electrostatic equipotential field lines 66 between the G2 screen grid 38 and the G3 focusing electrode 40 of the novel electron gun 26. Inclusion of the slot 62 inwardly from the outer aperture 59, but closely spaced thereto, causes a distortion of the field lines 66 at the outer aperture 59 of the G2 electrode 38. This distortion results in a shifting of the peak of the field lines at the aperture 59 to the left, as viewed in FIG. 5. Because of this shift, an electron beam passing through the center of the aperture 59 encounters sloped field lines which cause the outer beam to converge toward a center electron beam passing through the center aperture (not shown). A similar, but oppositely directed shift occurs to the electron beam passing through the center of aperture 57 due to the distortion of the field lines 66 induced by slot 60 (not shown in FIG. 5).

The convergence of the two outer electron beams causes the electron beams to enter the main focusing lens at a slight angle rather than straight on. It has been found that introduction of this angle approach to the focus lens reduces the horizontal motion sensitivity of the outer electron beams with respect to focus voltage changes.

Color picture tubes are tested for this sensitivity by varying the focus voltage from minus 1000 to plus 1000 volts relative to the tube's normal operating focus voltage (e.g., 7000 or 8500 volts), and then measuring the horizontal displacement of the outer electron beams at the tube screen. When such tests were performed on a tube containing a standard RCA "Hi-PI Electron Gun Mount", designated PI-30R, operated at a focus voltage of about 7000 volts an average horizontal displacement of 0.812 mm was recorded. In tests on a color picture tube of corresponding size, with the same gun modified by the addition of slots in the G2 electrode as described above, and operated at a focus voltage of 8500 volts, an average horizontal displacement of only 0.08 mm was recorded. The addition of the slots 60 and 62 in the G2 electrode thus had a substantial effect on reducing the tube's sensitivity to focus voltage change. In this modified electron gun, slots 60, 62, having a width of 0.76 mm (horizontal) and a length of 1.524 mm (vertical), were positioned inwardly from outer beam apertures 57,59 of 0.635 mm diameter by a spacing of 0.39 mm to 0.50 mm. The depth of the slots 60,62 is nominally 0.18 mm with a range from 0.15 mm to 0.20 mm. The thickness of the G2 electrode 38 is about 0.51 mm. Since the thickness of the G2 electrode 38 is about twice that of the first accelerating and focusing electrode 40 (G3), the slots 60,62 do not completely penetrate the electrode and can be formed close to the outer apertures 57 and 59, respectively, without weakening and/or distorting the outer G2 apertures. Furthermore, since the velocity of the electrons in the electron beams passing through the apertures in the G2 electrode 38 varies as the square root of the voltage, the electron velocity in the vicinity of the G2 electrode 38, which operates at about 600 volts, is considerably less than the electron velocity nearer to the G3 focusing electrode 40 which operates at about 8500 volts. The lower velocity electrons spend more time in the field associated with the G2 electrode 38, thus, the reconvergence apertures 60,62 formed in the G2 electrode inward of the outer beam apertures 57 and 59 have a greater effect on the outer electron beams than the slot apertures disclosed in the aforementioned Assil et al. patent application which were formed outward of the outer beam apertures in the G3 focusing electrode. Additionally, since in the electron gun described in the Assil et al. patent application, the focus voltage was only 7000 volts whereas in the present electron gun the focus voltage is 8500 volts, the aperture slots described by Assil et al., would be even less effective at the higher focus voltage required in the present electron gun.

Figure 7:
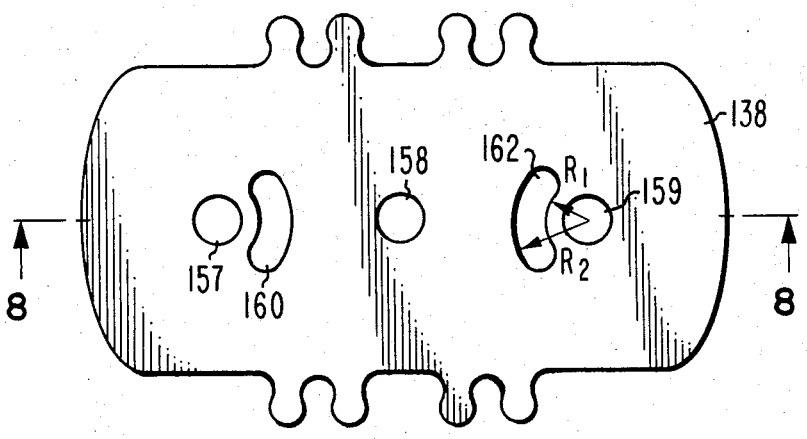
FIG. 7 is an enlarged elevational view of an alternative embodiment of a G2 electrode.
Figure 8:
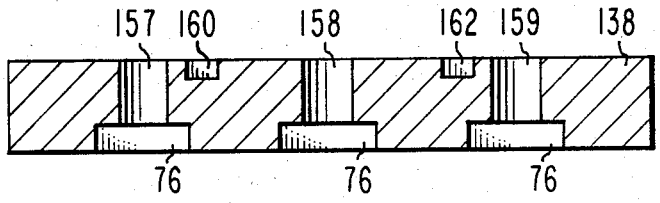
FIG. 8 is an enlarged cross-sectional view of the G2 electrode taken along line 8—8 of FIG. 7.

An alternative embodiment of the present novel G2 electrode is shown in FIGS. 7 and 8. As shown in FIG. 7, a screen grid electrode (G2) 138 has two arcuately shaped slots 160 and 162 spaced inwardly of the outer beam apertures 157 and 159, respectively. The radius, $R_1$, of the arcuate portion of each of the slots proximate to each of the outer beam apertures is about 0.89 mm, as measured from the center of the outer apertures, and the radius, $R_2$, of the arcuate portion of each of the slots remote from the outer apertures is about 1.52 mm, as measured from the center of the outer apertures. The slots 160 and 162 have a depth of about 0.13 mm. The arcuate slots 160 and 162 have a qreater symmetry with respect to the outer beam apertures than the rectangular slots 60 and 62. This greater symmetry provides additional reduction in the horizontal motion of the outer electron beams in the corners of the screen.

As shown in FIG. 8, the G2 electrode 138 may include rectangular slots 76 formed in the surface of the G2 electrode which faces the G1 electrode (not shown). The slots 76 are aligned with the apertures 157, 158 and 159 and create an astigmatic field that produces underconvergence of the electron beam in the vertical plane only to compensate for the vertical flare distortion of the beam spot at off-center positions on the image screen. When the rectangular slots 76 are utilized, the G2 electrode thickness is increased to about 0.711 mm. The rectangular slots 76 have a depth of about 0.2 mm. The slots 76 are disclosed in U.S. Pat. No. 4,234,814, issued to Chen et al., on Nov. 18, 1980 and incorporated herein for the purpose of disclosure.

GENERAL CONSIDERATIONS

The electron gun 26 is designed to operate with an ultor potential of about 30 kV applied to electrode 42 (G4) and about 8.5 kV applied to electrode 40 (G3). During the YAM operation described above, the G3-G4 voltages are optimized to converge the outer electron beams and the center beam at the shadow mask 24; however, if the G3-G4 voltage ratio is varied, e.g., by changing the G3 focus voltage relative to the G4 voltage, misconvergence occurs. If, for example, the G3 focus voltage is made more positive, the G3-G4 main focus lens is weakened and the outer beams tend to misconverge outwardly. At the same time, the increase in G3 focus voltage relative to the G2 screen grid voltage strengthens the G2-G3 lens action. Reconvergence slots 60,62 formed inward of outer beam apertures 57,59 strongly distort the electrostatic field formed between the screen grid electrode (G2) 38 and the first accelerating and focusing electrode and tend to converge the outer beams toward the center beam as the beams pass through the apertures in the G2 electrode. The slots 60,62 thus compensate for the misconvergence that occurs within the main focus lens.

Likewise, if the G3 focus voltage is made more negative, the G3-G4 main focus lens is strengthened, and the outer beams tend to converge inwardly. Simultaneously, the decrease in G3 focus voltage relative to the G2 screen grid voltage weakens the G2-G3 lens action. The reconvergence slots 60,62 distort the electrostatic field less strongly so that the outer beams tend to misconverge outwardly from the center beam as the beams pass through the apertures in the G2 electrode. The net effect is that the slots provide a compensating field between the G2-G3 electrodes which offsets any changes in the main focus lens, i.e., between the G3-G4 electrodes, caused by focus voltage variations.

What is claimed is:

1. In a color picture tube having an inline electron gun including at least a screen grid electrode and an accelerating and focusing electrode, said electrodes having a plurality of apertures therethrough including at least two outer apertures in portions facing each other, said apertures in said screen grid electrode being aligned with the facing apertures in said accelerating and focusing electrode, the improvement comprising:

the portions of said screen grid electrode facing said accelerating and focusing electrode including two precisely located reconvergence slots formed therein which are spaced sufficiently close to and inward from said outer apertures to cause a distortion of an electrostatic field formed between said screen grid electrode and said accelerating and focusing electrode at said apertures, said reconvergence slots having a depth less than the thickness of said screen grid electrode.

2. The tube as defined in claim 1, wherein each of said reconvergence slots has a rectangular shape.

3. The tube as defined in claim 2, wherein the rectangular slot has a width of about 0.76 mm and a length of about 1.52 mm.

4. The tube as defined in claim 2, wherein the spacing between each slot and the aperture adjacent thereto is in the range of 0.39 mm to 0.50 mm.

5. The tube as defined in claim 2, wherein the depth of each slot is in the range of 0.15 mm to 0.20 mm.

6. The tube as defined in claim 1, wherein each of said reconvergence slots has a generally arcuate shape with the concave portion of the slot being directed toward the aperture adjacent thereto.

7. The tube as defined in claim 6, wherein the radius of the arcuate portion of the slot proximate to the aperture is about 0.89 mm, as measured from the center of the aperture, and the radius of the arcuate portion of the slot remote from the aperture is about 1.52 mm, as measured from the center of the aperture.

8. The tube as described in claim 6, wherein the depth of said slots is about 0.13 mm.

9. In a color picture tube having an inline electron gun for generating and directing three electron beams along spaced coplanar paths toward a screen of said tube, said gun including at least four spaced apart electrodes including a control grid electrode, a screen grid electrode, a third electrode, and a fourth electrode, each of said electrodes having three inline apertures therethrough, said apertures in said screen grid electrode being aligned with the facing apertures in said third electrode, the improvement comprising the portion of said screen grid electrode facing said third electrode including two precisely located reconvergence slots formed therein, each of said slots being adjacent to a different one of the two outer apertures and spaced sufficiently close to and inward from the two outer apertures to cause a distortion of an electrostatic field formed between said screen grid electrode and said third electrode at the two outer apertures, said reconvergence slots having a depth less then the thickness of said screen grid electrode.

10. The tube as defined in claim 9, wherein each of said slots has a rectangular shape.

11. The tube as defined in claim 10, wherein the width of said rectangular slot is about 0.76 mm and the length is about 1.52 mm.

12. The tube as defined in claim 10, wherein the spacing between each slot and the outer aperture adjacent thereto is in the range of 0.39 to 0.50 mm.

13. The tube as defined in claim 10, wherein the depth of each slot is in the range of 0.15 mm to 0.20 mm.

14. In a color picture tube having an inline electron gun for generating and directing three electron beams along spaced coplanar paths toward a screen of said tube, said gun including at least four spaced apart electrodes including a control grid electrode, a screen grid electrode, a third electrode and a fourth electrode, each of said electrodes having three inline apertures therethrough, said apertures in said screen grid electrode being aligned with the facing apertures in said third electrode, the improvement comprising the portion of said screen grid electrode including two precisely located reconvergence slots formed therein, each of said slots being adjacent to a different one of the two outer apertures and spaced sufficiently close to and inward from the two outer apertures to cause a distortion of an electrostatic field formed between said screen grid electrode and said third electrode at the two outer apertures, said reconvergence slots having a generally arcuate shape with the concave portion of the slot being directed toward the adjacent outer aperture.

15. The tube as defined in claim 14, wherein the radius of the arcuate portion of the slot proximate to the outer aperture is about 0.89 mm, as measured from the center of the outer aperture, and the radius of the arcuate portion of the slot remote from the outer aperture is about 1.52 mm as measured from the center of the outer aperture.

16. The tube as defined in claim 14, wherein the depth of said slots is about 0.13 mm.

* * * * *

UNITED STATES PATENT AND TRADEMARK OFFICE

CERTIFICATE OF CORRECTION

PATENT NO. : 4,513,222

DATED : April 23, 1985

INVENTOR(S) : Hsing-Yao Chen

It is certified that error appears in the above-identified patent and that said Letters Patent is hereby corrected as shown below:

Column 3, Lines 34-35 - "voltage-vultor" should be

-- voltage-ultor -- .

Signed and Sealed this

*Twenty-sixth* Day of *November 1985*

[SEAL]

*Attest:*

DONALD J. QUIGG

*Attesting Officer*

*Commissioner of Patents and Trademarks*